US005119612A

United States Patent [19]

Taylor et al.

[11] Patent Number: 5,119,612

[45] Date of Patent: Jun. 9, 1992

[54] INSULATED ROOF STRUCTURE WITH FIRE RESISTANT PANELS MOUNTED THEREON

[75] Inventors: James E. Taylor, Seguin, Tex.; Robert J. Alderman, Ruskin, Fla.

[73] Assignee: Energy Blanket of Texas, Inc., Seguin, Tex.

[21] Appl. No.: 522,205

[22] Filed: May 11, 1990

[51] Int. Cl.[5] ..... E04G 21/00

[52] U.S. Cl. ..... 52/410; 52/407; 52/481; 52/483

[58] Field of Search ..... 52/406, 407, 408, 409, 52/410, 481, 483, 488, 479

[56] References Cited

U.S. PATENT DOCUMENTS

| | | | |
|---|---|---|---|
| 3,740,912 | 6/1973 | Sauer et al. | 52/483 X |
| 3,969,863 | 7/1976 | Alderman . | |
| 4,047,346 | 9/1977 | Alderman . | |
| 4,062,162 | 12/1977 | Nicklaus et al. | 52/481 |
| 4,075,807 | 2/1978 | Alderman . | |
| 4,275,541 | 6/1981 | Orals et al. | 52/407 X |
| 4,333,292 | 6/1982 | Musgrave . | |
| 4,573,298 | 3/1986 | Harkins . | |
| 4,817,355 | 4/1989 | Tilsley et al. | 52/407 |

*Primary Examiner*—Richard E. Chilcot, Jr.
*Attorney, Agent, or Firm*—Hopkins & Thomas

[57] ABSTRACT

An insulated roof structure which has improved fire resistant capabilities is formed on building systems structures by mounting a plurality of purlins (12) on inclined metal rafters (11) and supporting fire resistant panels (32) from the purlins (12). A plurality of support beams (25) are attached to the downwardly facing surface (51) of the purlins (12) and support the fire resistant panels (520. The fire resistant panels (52) are mounted to the support beams (25) and arranged in edge-to-edge contact with one another with the side edges (47) and (48) of adjacent fire resistant panels (52) in sealed engagement with one another.

26 Claims, 5 Drawing Sheets

INSULATED ROOF STRUCTURE WITH FIRE RESISTANT PANELS MOUNTED THEREON

FIELD OF THE INVENTION

The present invention relates in general to an insulated roof structure for building systems structures and the like. More particularly, the present invention relates to an insulated roof structure of a metal building having layers of insulation material in the roof structure, with blanket insulation extending over the purlins and fire resistant panels attached to and extending beneath the purlins, and to a method of installing the fire resistant panels in the roof structure of a metal building.

BACKGROUND OF THE INVENTION

In the prior art industrial buildings such as building systems structures of the type that include metal purlins supported on inclined metal rafters and sheet metal roofing panels attached to the purlins, the spread of fires usually is difficult to control when the fire reaches the roof because of the expanse of open space beneath the roof structure. This generally is due to the effect of the movement of heated gases and flames through the open space beneath the roof structure of the building. Once the fire has spread to the roof of the building, the fire usually is already out of control and it becomes likely that the building will be destroyed by the fire.

Fire resistant insulation material has been developed and installed in industrial buildings to help in the control of the spread of fires through such buildings. Such insulation materials typically have been used in conjunction with a poured concrete deck over which the fire resistant material is placed, with a built up roof structure on top of the fire resistant material and the concrete deck. Such an arrangement typically provides effective protection against the spread of fire and gases through a concrete roof.

However, such fire resistant materials are not nearly as effective when used in building systems structures which do not use a concrete slab-based roof structure. The omission of the concrete slab apparently reduces the effectiveness of the fire resistant material to resist the spread of fire and hot gases through the roof structure of the building. Further, panels formed from such fire resistant materials often have an irregular shape, making it difficult to form a tight seal between adjacent panels.

The suspended insulation systems taught by the prior art for use in the roof structures of building systems structures typically suspend fire resistant panels on top of metal cross pieces suspended from the purlins of the roof structure by metal hangers. Such an abundance of metal fixtures hanging below the fire resistant panels of the roof structure provides direct heat conductivity and heat absorption through the roof structure. Thus, the effectiveness of the fire resistant panels to retard the spread of flames and combustible gases is decreased by the significant exposure of metal to metal contact of the prior art systems.

Consequently, to achieve a standard one hour fire rating for the roof structure of building systems structures it has been necessary to use a substantially greater amount of fire resistant material in the roof structure, which increases the cost of the roof structure. When only one layer of fire resistant material is used in the roof structure as generally taught by the prior art, the single layer of material must be able to withstand the entire amount of temperature gradient from the hot side to the cool side of the roof structure. This requires a relatively large thickness of the insulation material, which results in the inconvenience and expense of installing heavier, thicker, expensive material. An alternative has been to simply not build a building systems structure but to build another type of building. As a result, it has been generally believed impractical to erect a building systems structure in areas where fire code regulations require roof structures to have at least a one hour fire resistance rating.

Accordingly, it can be seen that it would be desirable to provide an insulated roof structure for building systems structures and a method of installing such a roof structure which provides an effective and inexpensive flame and gas seal to retard the spread of flames and hot gases from a fire through the roof structure of the building.

SUMMARY OF THE INVENTION

Briefly described, the present invention comprises an insulated roof structure for a building systems structure which provides the roof structure with improved flame and hot gas resistant properties. In a preferred form of the invention, the means for improving the fire resistance properties of the roof structure comprises covering the upper surfaces of the purlins of the roof structure with a blanket of fiberglass insulating material and then installing the metal roof panels on top of the fiberglass blanket to create an insulation barrier at the upper surface of the roof structure between the metal roof panels and the purlins. To provide a fire penetration barrier at the lower surface of the roof structure, a plurality of support beams are attached to the lower surfaces of the purlins of the roof structure and panels of a resilient fire resistant material are attached to the support beams, for example, by a fastening means driven through the panels and into the support beams, thus securing the fire resistant panels to the roof structure.

The fire resistant panels are lifted upwardly into contact with the support beams as they are being installed. The side edges of the fire resistant panels abut the side edges of adjacent fire resistant panels and form seams which seal against flame and hot gas penetration of the roof structure.

The fire penetration seal between the fire resistant panels can be a compression seam. A method of forming the compression seam comprises first connecting the panels to the support beams by installing fasteners, such as self-drilling screws, through the field of the panels and into the support beams, with the edges of each newly installed panel overlapping the edge of its adjacent previously installed panels. After the panels have been secured to the support beams, the overlapping side edges of the panels are urged into the gap between the panels and thus into tight compression contact with one another to form a substantially fire an impermeable sealed seam between the panels. Additional fasteners can be installed at the seams.

In another form of the invention, the fire penetration joint formed between the side edges of the fire resistant panels can be a mitered joint, a lap joint, a tongue and groove joint, or other types of edge sealing joints, all of which will serve to lock and seal the side edges of adjacent fire resistant panels together. The fire resistant panels are pressed together such that the opposing jointing surfaces of the side edges of adjacent panels engage and are forced into tight contact with one another. This forms a substantially fire impermeable seam or joint between the adjacent fire resistant panels without requiring the application of fire caulking between each fire resistant panel. Once the side edges of adjacent fire resistant panels have been urged into locking engagement with one another, a plurality of self-drilling fasteners, such as self-tapping screws, are inserted into the field of each panel and through the support beams to hang the panels on the support beams.

This arrangement of the fiberglass insulation blanket covering the top of the purlins and the fire resistant panels hung beneath the purlins of the building systems structure provides the roof structure of the building with an effective flame and gas seal and with enough layers of insulation between the heat source and the roof panels to resist failure of the roof structure for more than one hour in a standard fire test.

For example, if the temperature in the building structure reaches 1700° F. the panels form a fire resistant barrier with a temperature gradient from about 1700° to 1100° F., and the fiberglass blankets form a heat resistant barrier with a temperature gradient from about 980° F. to 305° F., with the dead air trapped between the panels and blankets providing some heat resistance to the structure. If the thickness of the panels and/or blankets are changed, the temperature gradients will change; however, the use of the panels below the blanket insulation results in a reduction of the temperature across the lower portion of the roof structure before the heat reaches the upper layer of insulation. This permits the use of the blanket insulation that has lower temperature resistance and is less expensive and easier to install than the panels, whereas the use of the blanket insulation permits the use of light weight, thinner panels that are easier and less expensive to install than thicker panels.

Thus, it is an object of this invention to provide a roof structure having improved fire resistance capabilities for a building systems structure.

Another object of this invention is to provide an insulated roof structure for a metal building having improved fire resistance capabilities wherein a plurality of fire resistant panels are mounted in edge-to-edge sealed engagement in the roof structure to provide the roof structure with effective fire protection seal, which is economical to install and substantially maintenance free.

Another object of the invention is to provide layered insulation barriers in a roof structure of a metal building or the like with the lower barrier to provide heat resistance as high as the temperature of the fire in the building and the upper barrier to provide heat resistance as high as the temperature transferred from the lower barrier to the upper barrier.

Another object of the invention is to provide a roof structure with a layered insulation barrier with the lower barrier formed of a material of relatively high heat resistance and an upper barrier formed of a material of lower heat resistance.

Another object of this invention is to provide a method for mounting a plurality of fire resistant panels to the roof structure of a building systems structure which provides an effective and inexpensive fire resistant roof for the building.

Other objects, features and advantages of the invention will be understood from reading the following specification when taken in conjunction with the accompanying drawings.

DESCRIPTION OF THE PREFERRED EMBODIMENT

Figure 1:
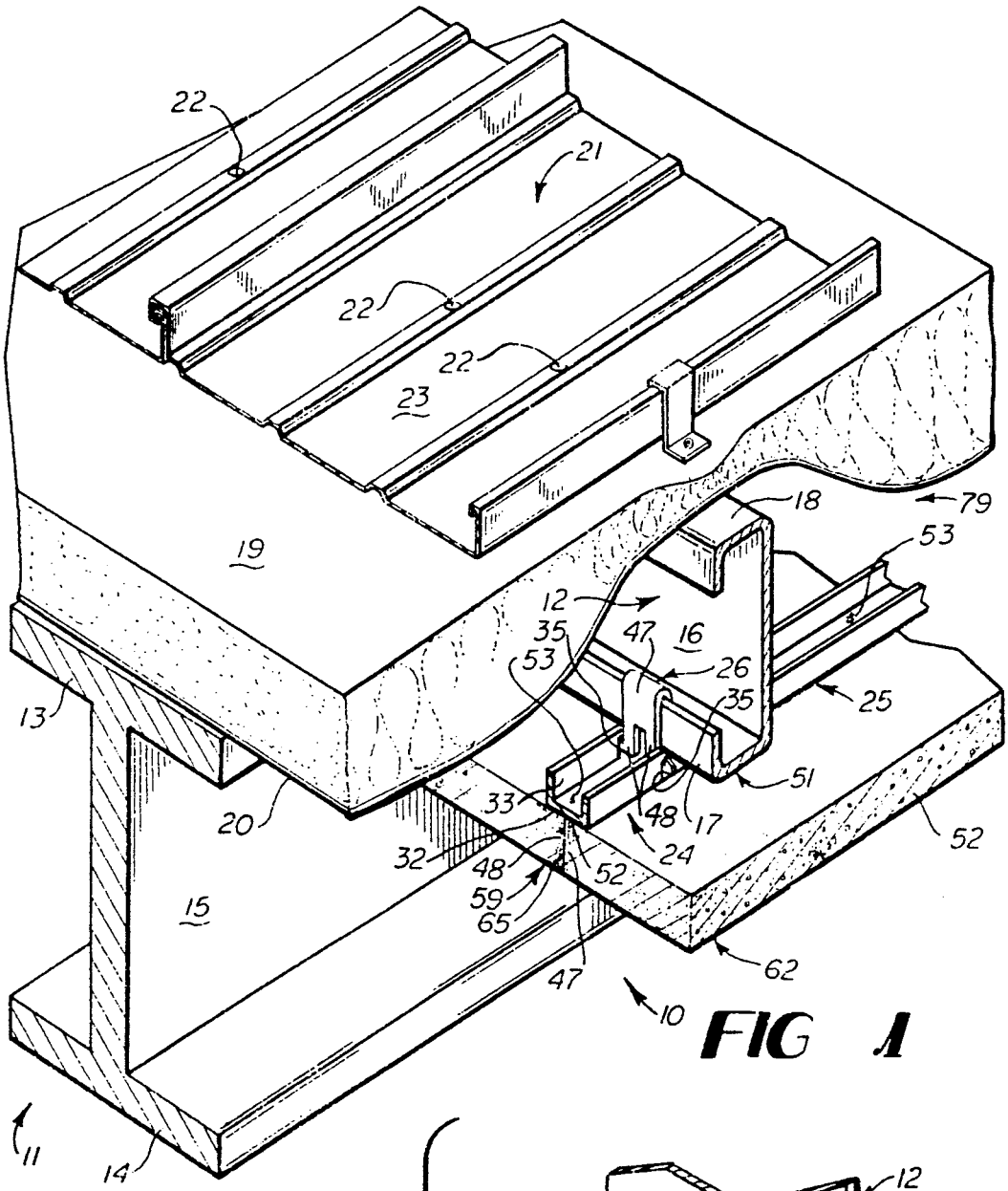
FIG. 1 is a perspective illustration of a portion of a fire resistant roof structure of a metal building with fire resistant panels and blanket insulation, with parts broken away to show the arrangement of the structure.

Referring now in greater detail to the drawings, in which like numerals indicate like parts throughout the several views, FIG. 1 illustrates in part a roof structure 10 which includes a plurality of spaced apart parallel rafter beams 11 (only one of which is shown). Each rafter beam 11 has a substantially I-shaped construction and includes an upper flange 13, a lower flange 14 and a central web 15. A plurality of spaced parallel purlins 12 (only one of which is shown) are mounted to the upper flange 13 of each rafter beam 11. The purlins 12 rest upon the upper flanges 13 of the rafter beams 11, and are supported by the rafter beams 11. Each purlin 12 shown herein has a substantially C-shaped configuration, and includes a central web 16, a lower flange 17 and an upper flange 18. It should be noted that although the purlins 12 shown in the drawings have a C-shaped configuration, the present invention is equally well suited for use in a roof structure having purlins of substantially different configurations. A plurality of fasteners (not shown) are driven through the lower web 17 of the purlins 12 into the upper flange 13 of the rafter beam 11 to thus secure each purlin 12 to the rafter beams 11.

Blankets of insulating material 19 are rolled out from reels of insulation (not shown) and extend across and over the top of the purlins 12, with the blankets forming a continuous blanket of insulation resting on the upper flanges 18 of each purlin 12. The insulating material is preferably a fiberglass blanket insulation with a thickness of approximately 3 to 6 inches and a vapor barrier sheet, such as vinyl sheet 20, is adhesively attached to the lower surface of the fiberglass blanket 19. The blanket insulating material 19 retards the transfer of heat and vapor through the roof structure 10. A layer of poultry netting can be applied to the lower surface of the vapor barrier sheets, if desired.

While the insulating blankets 19 are illustrated as extending between the purlins by extending across the purlins, the blankets can be arranged parallel to the purlins and placed down between the purlins and still extend between and generally fill the spaces between the purlins.

Sheets of metal roofing material 21 are placed over the blanket of insulation material 19. A plurality of fasteners 22 secure the sheets of metal roofing 21 to the purlins 12 of the roof structure 10. The fasteners 22 are driven downwardly into the upper surface 23 of the metal roofing 21 and pass through the insulation material 19 and into the upper flanges 18 of the purlins 12. Thus, the metal roofing 21 is securely attached to the purlins 12.

Below the purlins 12 a plurality of support beams 25 (only one of which is shown in FIG. 1) are attached to the lower flanges 17 of the purlins 12 by a fastener 26. As shown in FIGS. 1–4, the support beams 25 can be conventional U-shaped beams or channels 24. However, as illustrated in FIGS. 5A–5E, the support beams 25 can also be chosen from a variety of conventional supporting members including U-shaped beams 24 (FIG. 5A), rectangular shaped box beams 27 (FIG. 5B), Z-shaped beams 28 (FIG. 5C), C-shaped beams 29 (FIG. 5D), or a simple metal strap 31 (FIG. 5E).

Figure 2:
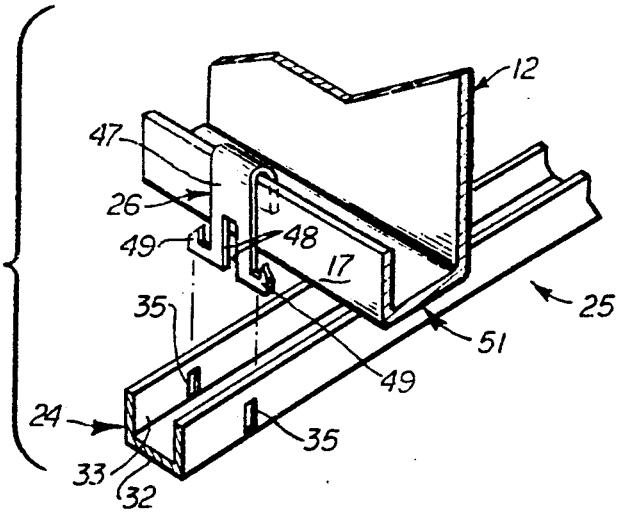
FIG. 2 is a perspective illustration of the mounting clips which mount the support beams to the purlins.
Figure 5A:
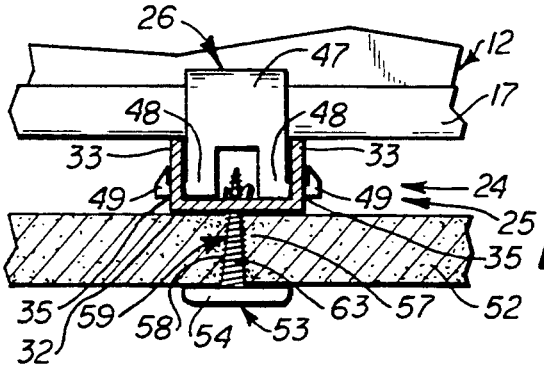
FIG. 5 is a cross-sectional view and FIGS. 5B–5E and perspective views of different types of support beams, showing how each type of support beam is suspended from the purlins of the roof structure and how the heat resistant panels are mounted to the support beams and form sealed joints in the lower level of insulation.

When viewed in end cross section in FIGS. 1, 2 and 5A each U-shaped beam 24 has a laterally extending center panel 32, and a air of upwardly extending, substantially straight side walls 33. Holes 35 are formed in the side walls 33 of the U-shaped beams 24 arranged at one foot centers along the length of the U-shaped beams 24.

Typically, the holes 35 formed in the side walls 33 of the U-shaped beams 24 will be cut into the metal blank used to form the U-shaped beams 24 prior to their being rolled and shaped. However, it is possible to form the holes 35 while at the job-site using a Whitney Punch (not shown) or similar hand held hole punch device or a conventional power-drill. A Whitney Punch is similar to a pair of pliers but has a pair of cutting die in place of the grippers of the pliers. The die of the Whitney Punch can be interchanged to form any size or shape hole desired.

To form the holes 35 using a Whitney Punch, the jaws of the punch are spread apart and placed in position about the side walls 33 of the U-shaped beams 24. As the jaws of the punch are closed, the opposing die cut through the metal of the beam to thus form the holes 35. If a drill is used to form the holes 35, the drill bit is simply placed in the proper cutting position and bores into the side walls 33 to form the holes 35. Generally, if the holes 35 are to be formed in the side walls 33 of the U-shaped beams 24 at the job-site, the holes 35 will be drilled or punched in the side walls 33 of the U-shaped beam 24 while the U-shaped beams 24 are still at ground level, although it is possible to form the holes 35 as the U-shaped beams 24 are actually being installed.

Figure 5B:
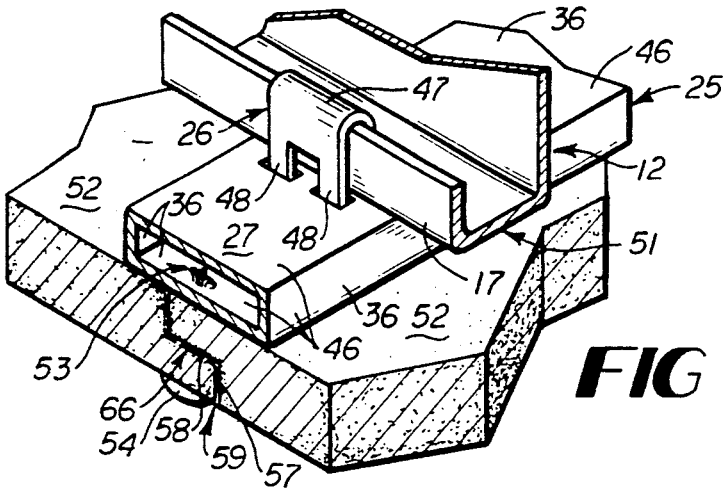

As shown in FIG. 5B, the box beam 27 has a rectangular configuration with four side walls 36.

Figure 5C:
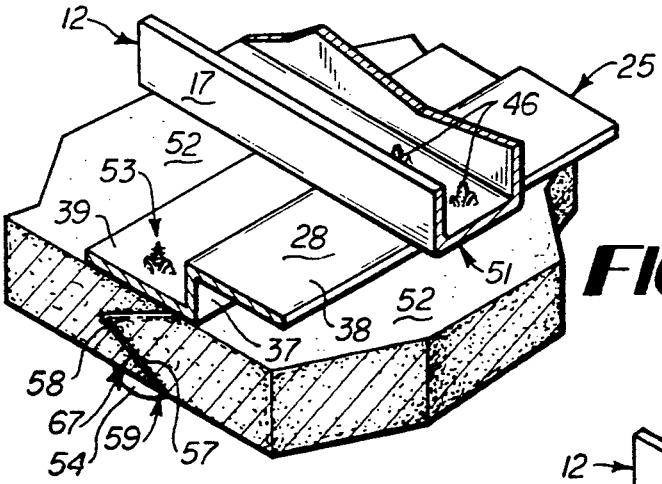

The Z-shaped beam 28, shown in FIG. 5C, has a central web 37 and upper and lower flanges 38 and 39 extending in opposite directions away from the central web 34.

Figure 5D:
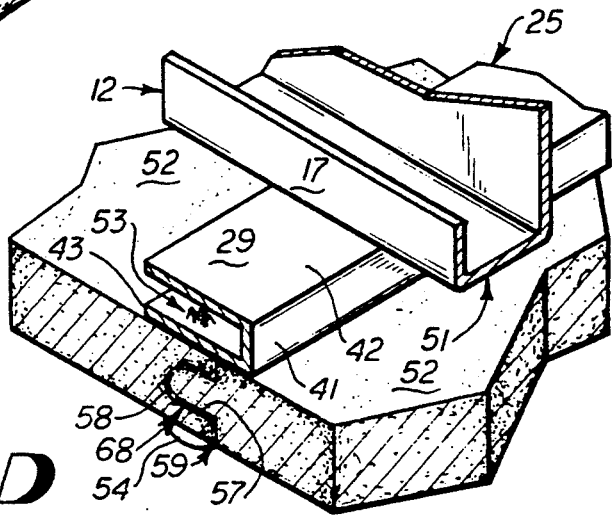

FIG. 5D illustrates the C-shaped support beam 29, having a web 41 and upper and lower flanges 42 and 43 extending parallel to one another away from the web 41.

As illustrated in FIG. 5E, the metal strap 31 is a substantially flat strip of metal.

Figure 4:
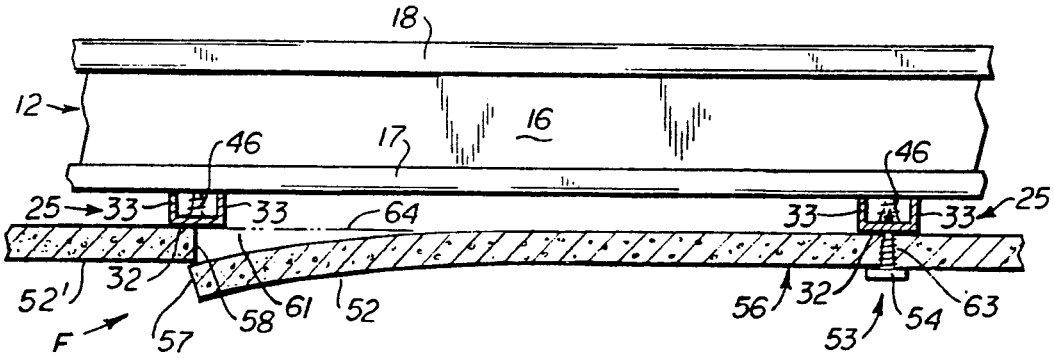
FIG. 4 is an end view of one embodiment of adjacent fire resistant panels showing the most recently, partially installed panel overlapping a previously installed panel prior to the adjacent edges being compressed into edge-to-edge contact with one another to form a compression seam.
Figure 5E:
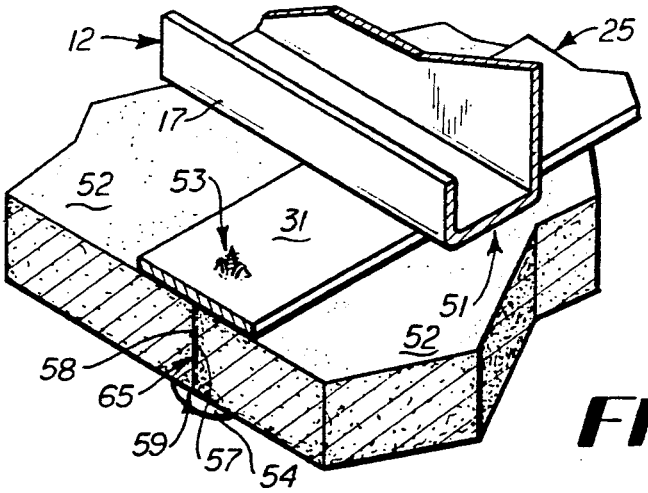

As shown in FIG. 4, the fasteners which hold the support beams 25 to the purlins 12 can be conventional fasteners such as screws or rivets 46. Also, the fasteners can be mounting clips 26 such as shown in FIGS. 1, 2 and 5A so as to expedite the mounting of the U-shaped beams of the purlins. As illustrated in FIG. 2, the mounting clips 26 are generally U-shaped clips having a hooked upper portion 47, a pair of L-shaped arms 48 extending downwardly from the upper portion 47, and a wedge-shaped end portion 49 at the end of each arm 48.

The U-shaped beams 24 are positioned with their horizontal flanges 29 abutting the lower surfaces 51 of the lower flanges 17 of the purlins 12, and are secured to the lower flanges 17 by mounting clips 26. As shown in FIG. 2, the mounting clips 26 are positioned with their upper portions 47 hooked over the lower flange 17 of the purlins 12 with the wedge-shaped ends 49 of the L-shaped arms 48 of the mounting clips 26 inserted in the openings 35 in the side walls 33 of the U-shaped beams 24 to securely hold the U-shaped beams 24 to the purlins 12.

The mounting clips 26 typically will be formed by being stamped from a metal (i.e. steel) blank having a sufficient tensile strength to securely support and hold the U-shaped beams 24 to the purlins 12 without allowing the U-shaped beams 24 to shift or become otherwise dislocated. Additionally, the metal of the mounting clips 26 also should be sufficiently ductile so as to enable the L-shaped arms 48 of the mounting clips 26 to bend back and forth to align the wedge-shaped ends 49 of the L-shaped arms 48 with the holes 35 in the side walls 33 of the U-shaped beams 24 without resulting in the weakening of the metal of the mounting clips 26. Consequently, if the holes 35 have not been correctly formed on one foot centers, there will be no need to have to punch or drill new holes 35 as a simple adjustment can be made by bending the L-shaped arms 48 to align their wedge-shaped ends 49 with the holes 35. However, if the holes 35 are too far off center or have not been correctly formed, a conventional hand held power drill or hole punch can be used to form the holes 35 as the U-shaped beams 24 are being installed.

Figure 3:
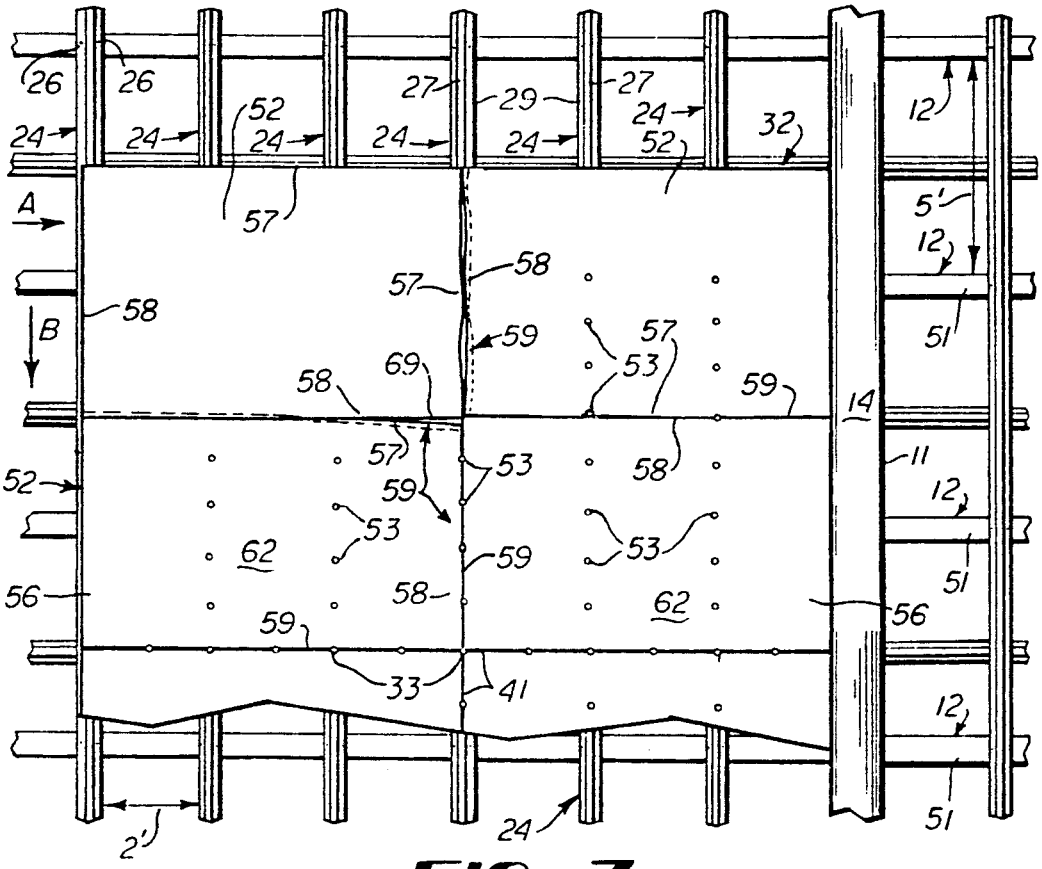
FIG. 3 is a partial bottom view of the fire resistant roof structure showing the fire resistant panels mounted to the support beams.

In the embodiment of the invention shown in FIGS. 1–4 a plurality of fire resistant panels 52 are secured to the center panels 32 of the U-shaped beams 24 by a fastening means 53. As shown in FIG. 3, each fire resistant panel 52 is a rectangular board approximately five feet wide by six feet long and is approximately two inches in thickness. The combination of the fiberglass insulating blanket together with the fire resistant panels 52 allows panels of a relatively reduced thickness to be used while still providing the roof structure 10 with enhanced fire resistance protection. Preferably, each fire resistant panel 52 will be a composite board formed from a fibrous, heat insulating fire resistant material which has a flame spread rating of 25 or less and a smoke development factor of 5 or less. Preferably, an insulating material which 10 is a glass or mineral fiber composite heat insulation material encapsulated in an exterior metallic foil facing (i.e. aluminum) such as THERMAFIBER ® Curtain Wall insulation produced by United States Gypsum, or KAOWOOL FIREMASTER ® fire proof insulation material produced by Thermal Ceramics, or PYROFIBER ®, produced by the Mansville Corporation of Denver, Colorado will be used. Such insulating materials are relatively dense, having an approximate density of 8 lb/ft$^2$. It is preferred that the density of the fire resistant panels be about 8 lb./ft.$^3$ or less as it is desirable that the panels be somewhat compressible at least at their edges and resilient enough to withstand bending and compression forces without breaking.

The fastening means which secure the fire resistant panels 52 to the U-shaped beams 24 generally are self-drilling fasteners 53 such as bugel-headed screws. As shown in FIGS. 4 and 5A, it is desireable that the head 54 of each fastener 53 be substantially flat such that the head 54 of each fastener will be substantially flush with the downwardly facing surface 56 of the fire resistant panels 52.

As the fire resistant panels 52 are positioned on the U-shaped beams 24 and secured with fasteners 53, the technique of compression of the side edges 57 and 58 of adjacent panels 52 can be used to form a fire sealed joint 59. As shown in FIG. 4, the side edges 57 and 58 of each subsequently positioned panel 52 are overlapped over the side edges 58 and 57 of previously positioned, adjacent panels 52. As FIG. 4 illustrates, this overlapping creates a compression gap 61 between the adjacent panels 52.

The amount of overlap of the side edges 57 and 58 of adjacent fire resistant panels 52 which is formed by the installer varies according to the compressibility of the fire resistant panels 52 used. If the fire resistant panel material is relatively dense and hence only slightly compressible, the amount of overlap is relatively small, approximately ¼ inch or less. If the fire resistant panel material is less dense and more compressible, the amount of overlap can be increased as needed to insure a tight compression fit between the fire resistant panels 52.

As FIGS. 3 and 4 illustrate, the field 62 of each fire resistant panel 52 is secured to the U-shaped beams 24 with fasteners 53 after each panel 52 has been placed in the correct mounting position. The fasteners 53 are inserted upwardly through each panel 52 and though the U-shaped beams 24 at spaced apart points over the field 52 of each panel 52. As FIG. 4 illustrates, the shank portion 63 of each fastener 53 extends upwardly through the center panel 32 of each hat channel 24, pulling the fire resistant panels 52 into contact with the U-shaped beams 24.

Once the field 62 of a fire resistant panel 52 has been secured to the U-shaped beams 24, the overlapping side edges 57 and 58 of the fire resistant panels 42, which overlap the side edges 58 and 57 of the previously installed adjacent panels 52 are manually urged in the direction of arrow F (shown in FIG. 4) inwardly and upwardly into the compression gap 61 between the panels with the side edges of the panels 52 in compression contact with the adjacent edges of adjacent panels 52 into a position illustrated by phantom line 64 of FIG. 4. This compression contact or fit between adjacent fire resistant panels 52 creates the compression joints or seams 59 (FIG. 3) between the panels 52 to provide the roof structure with enhanced fire protection seals at the joints 59.

As shown in FIGS. 3 and 5A, additional fasteners 53 are driven into the fire resistant panels 52 and U-shaped beams 24 along the side edges 57 and 58 of the panels 52 to help secure the panels 52 to the roof structure 10 after the fire penetration joints 59 (FIG. 1, 3 and 4) have been formed between the adjacent fire resistant panels 52.

It should be noted that although FIGS. 1, 4, 5A and 5E illustrate the concept of compressing the side edges 57 and 58 of adjacent panels 52 to create a compression seam 59 at the fire penetration joint 59 and the use of U-shaped beams as support beams, it will be possible to use other types of sealed joints to form a sealed roof structure, and other types of support beams. As shown in FIGS. 5B-5D, different types of support beams 25 can be used and the side edges 57 and 58 of the panels 52 can form the male and female jointing surfaces such as a lap joint 66 (FIG. 5B), a mitered joint 67 (FIG. 5C), or a tongue and groove joint 68 (FIG. 5D). Frequently, the fire resistant panels 52 are not perfectly rectangular (as shown in FIG. 3), and thus often do not fit together in a perfectly snug fashion. Such irregularities tend to cause gaps or spaces 69 between the side edges 57 and 58 of adjacent fire resistant panels 52 such that the formation of a tight compression seal at the fire penetration joint 59 is difficult to form. The different fire penetration joints 59 illustrated in FIGS. 5B-5D function to both facilitate the compression of the side edges 57 and 58 to form a compression seal, and act as locking means to form a substantially fire and vapor impermeable joint when compression of the side edges 57 and 58 is not possible.

To install the fire resistant panels 52 using a lap joint 66, mitered joint 67 or tongue and groove joint 68, the panels 52 are placed upon the support beams 24, 27, 28, 29 or 31 and are urged in the direction of Arrows A and B as shown in FIG. 3. The side edges 57 and 58 of the panel 52 are urged into engagement with the opposing side edges 58 and 57 of the adjacent fire resistant panels 52. The male and female jointing surfaces formed by the side edges 57 and 58 of each panel 52 are thus forced into locking engagement with one another, spanning any gaps 59 between the panels. This locking engagement of the side edges 57 and 58 form the fire sealed joints 59 between the adjacent panels 52.

Fasteners 53 are inserted upwardly through the panels 52 after they have been pushed inwardly to engage their side edges 57 and 58. The fasteners 53 are first inserted throughout the field 62 of the panels 52 at points spaced approximately one foot apart. Additional fasteners 53 are installed along the fire penetration joints 59 after the field 39 of the panels 62 has been secured to the support beams 25 to complete the attachment of the panels 52 to support beams 25.

Figure 6:
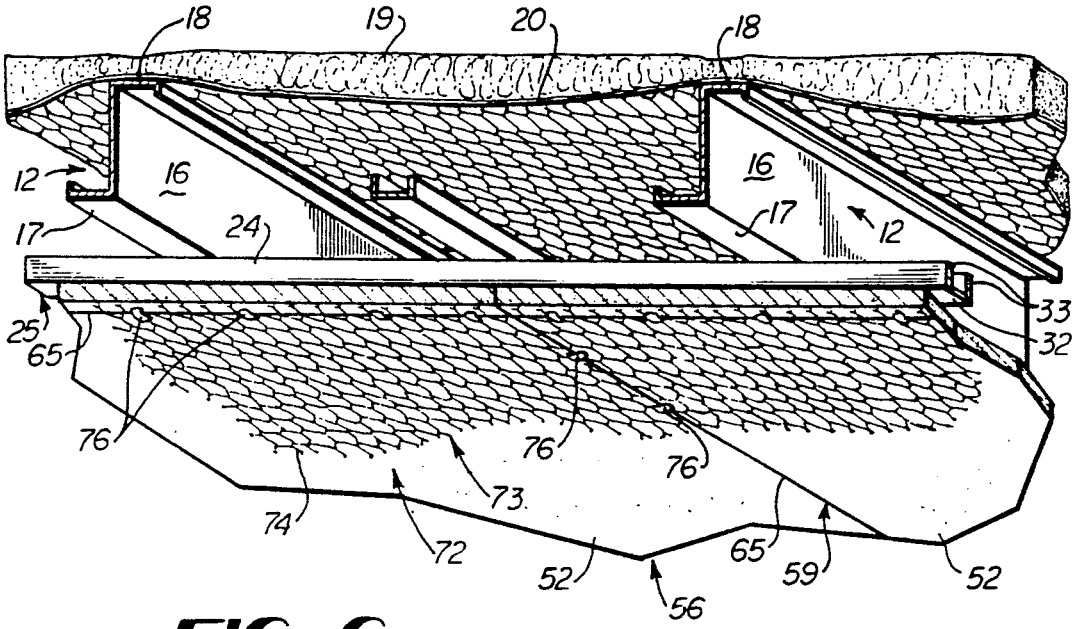
FIG. 6 is a perspective view of the bottom and an edge of the insulated roof structure showing poultry netting used on the backing sheet of the blanket insulation and on the lower surface of the fire resistant panels.
Figure 7:
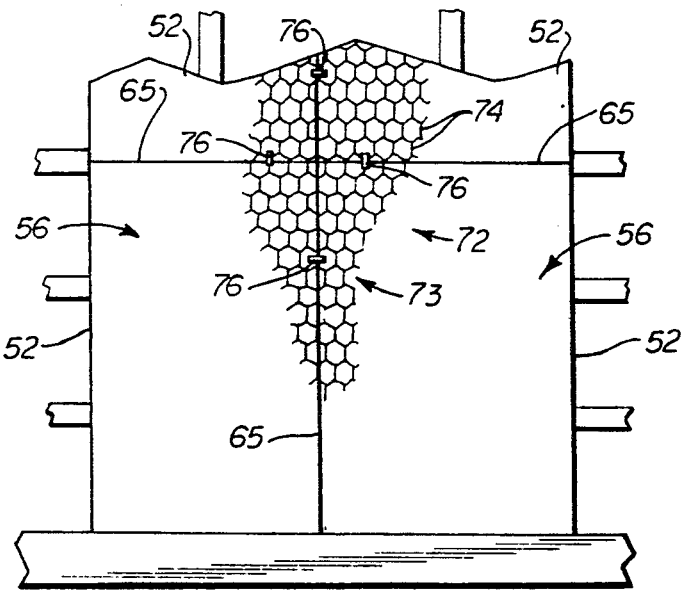
FIG. 7 is a bottom view of panels having poultry nettings.

Additionally, as shown in FIGS. 6 and 7, layers of poultry netting 71 and 72 can be laminated to the vapor barrier sheet 20 of the insulation blanket 19 and to the downwardly facing surface 56 of the fire resistant panels 52 respectively. The poultry netting is generally a wire mesh formed from a plurality of six-sided wire rings 73, fabricated from a wire such as aluminum having a low rate of thermal conductivity, having a hem portion 74 and formed in six foot wide sheets which are adhered or laminated directly to the vapor barrier sheet 20 and to the downwardly facing surface 56 of the fire resistant panels 52. The addition of the layers of poultry netting 71 and 72 provides greater stability and aids in holding of the insulation blanket 19 and the fire resistant panels 52 in place when they are exposed to extreme heat. Over time, both the fire resistant panels 52 and especially the insulation blanket 19 will tend to lose their own inherent stability due to exposure to extreme heat and will begin to melt and sag. The sagging of the insulation blanket and the fire resistant panels causes the deterioration of the panels and insulation blanket to be accelerated, thereby accelerating the total failure of the roof structure due to fire. The poultry netting 71 and 72 stabilizes and helps resist the tendency of the panels and the insulation material to sag, thus extending the life of the roof structure.

Figure 8A:
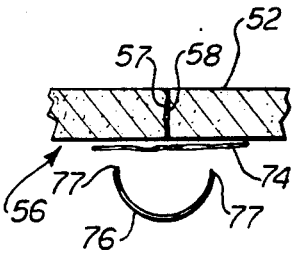
FIGS. 8 and 8B show how the poultry netting of adjacent panels are connected together with hog rings.
Figure 8B:
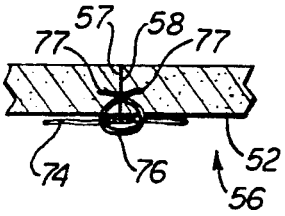

As FIGS. 8A and 8B illustrate, the sheets of poultry netting 72 covering adjacent fire resistant panels 52 and secured together by a plurality of fasteners such as "hog rings" 76. As shown in FIGS. 8A and 8B, each of the hog rings 76 is inserted upwardly into the fire resistant panels 52 through the wire rings 73 of the poultry netting 72 immediately adjacent the fire penetration joint 59 between the adjacent fire resistant panels 52, the hog ring usually and penetrate the panels themselves.

A pliers tool (not shown) is used to urge the ends 77 of the hog rings 76 toward one another (FIG. 8B). As FIG. 7 shows, the hem portions 74 of adjacent wire rings 73 of the layer of poultry netting 72 are also pulled together by the clamping action of the hog rings 76. As a result, the side edges 57 and 58 of adjacent fire resistant panels 52 are pulled into even tighter compression contact with one another at the compression seam 65 formed between the panels. Such tight compression contact correspondingly reduces the number of fasteners 53 necessary to secure the side edges 57 and 58 of the fire resistant panels 52 as shown in FIGS. 3 and 4. Thus, the amount of direct metal-to-metal contact through the fire resistant panels 52 (FIG. 1) to the insulation material 19 is reduced. Hog rings or similar fasteners also can be used to connect the poultry netting 71 of the blanket insulation 19, if desired.

Figure 9:
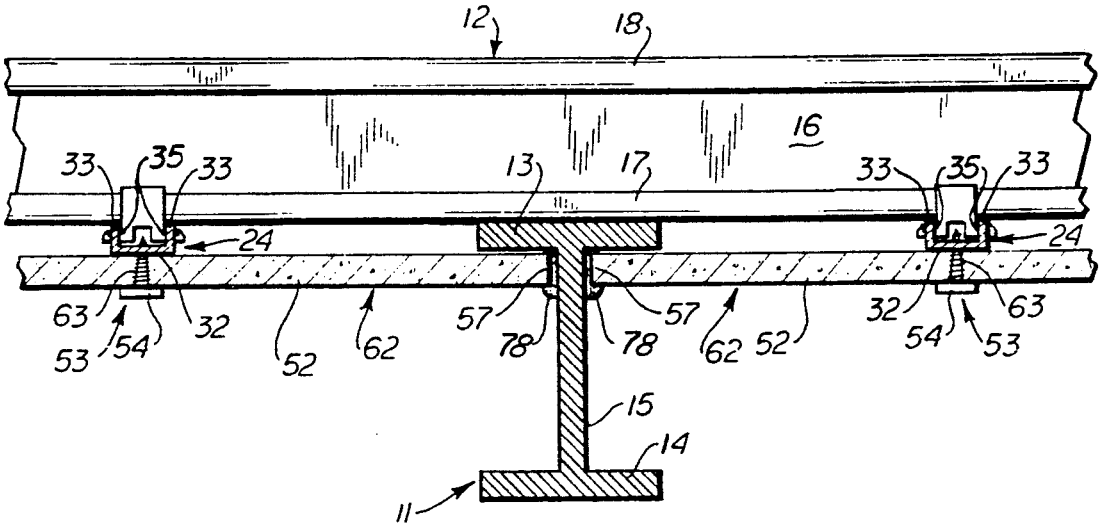
FIG. 9 is a side cross-sectional view of the position and placement of the fire resistant panels adjacent a rafter beam of the roof structure.

FIG. 9 illustrates the placement and mounting of the fire resistant panels 52 whose side edges 57 are adjacent rafter beams 11 of the roof structure. A fire penetration joint 59 (FIGS. 1 and 2) as is formed between the abutting side edges 57 of adjacent fire resistant panels 52 will not be formed between the side edges 57 of the fire resistant panels 52 and the side surfaces of the rafter beams 11 (FIG. 5). As shown in FIG. 5, the fire resistant panels 52 instead will be placed with their side edges 57 abutting the central web 15 of each rafter beam 11, and any gaps or openings between the side edges 57 of the fire resistant panels 52 and the central web 15 of the rafter beam 11 will be filled with a rated insulating fire caulking 78. 17

Though not illustrated herein, a substantially similar construction can be used to seal the gaps between the side edges of the fire resistant panels 52 and the side walls of the building. Fire caulking 78 also will be used to seal any small gaps on cracks formed in the roof structure 10 (FIG. 1) during its construction.

As illustrated in FIG. 1, air spaces 79 will be formed between the fire resistant panels 52 and the blanket of insulating material 19. The air spaces 79 aid in the insulation of the roof structure 10 by trapping dead air between the insulation blankets 19 and the fire resistant panels 52, and the dead air spaces are designed to be a part of the roof structure 10.

Further, as FIGS. 1 and 3 illustrate, only a small amount of metal which extends completely through the fire resistant panels 52 in contact with the support beams 25 is exposed below the panels 52. Only through the heads 54 of fasteners 53 in the field 62 of the panels will there be a direct path of metal-to-metal contact for the transfer of heat through the panels after the panels 52 are secure, unlike prior art fire resistant roof structure which have a significantly larger amount of the metal hardware of the roof structure exposed. By limiting the amount of exposed metal which extends through the roof structure 10, the present invention minimizes the absorption of heat through the roof structure 10. The absorption of heat is a major factor in the spread of fire through the roof structure, leading to the untimely failure of the roof structure. Consequently, by reducing the absorption of heat through the roof structure, the fire resistance properties of the roof structure are enhanced.

The total "R-value" (insulation value or measure of thermal resistance of the roof structure) of the roof structure can be upwards of 20.5. By using the above-described combination of fiberglass insulation blanket together with fire resistant thermal panels, the roof structure is thus provided with improved thermal resistance capabilities at a significantly reduced cost when compared with the known prior art.

It will be understood that the foregoing relates only to a preferred embodiment of the present invention. It should be understood by those skilled in the art that numerous changes and modifications can be made to the described embodiment of the invention without departure from the spirit and scope of the invention as set forth in the following claims.

We claim:

1. A method of fire proofing a roof structure of a building of the type including a plurality of spaced apart rafters and a plurality of spaced parallel purlins mounted on the rafters, comprising the steps of:

mounting a plurality of support beams to the lower surfaces of the purlins:

positioning a plurality of fire resistant panels against the lower surfaces of the support beams with the side edges of successive panels overlapping the adjacent side edges of adjacent panels thereby forming compression gaps between adjacent panels attaching the fire resistant panels to the support beams at positions away from the compression gaps;

compressing the overlapping side edges of the fire resistant panels into the compression gaps formed between adjacent fire resistant panels and aligning the adjacent edge of the panels to form edge-to-edge compression seams, and securing the side edges of the fire resistant panels to the support beams after the overlapping side edges of the fire resistant panels have been compressed into the compression gap between adjacent fire resistant panels.

2. The method of claim 1 and further including the step of:

covering the upper surface of the purlins with an insulation material, placing a plurality of roofing panels over the insulation material, and securing the roofing panels and insulation material to the purlins.

3. The method of claim 1 and wherein the step of compressing the overlapping side edges of the fire resistant panels comprises urging the overlapping side edges inwardly and upwardly into the compression gaps between adjacent fire resistant panels, and pressing the side edges of adjacent fire resistant panels into frictional contact with one another to thereby forming a substantially fire and vapor impermeable seal between the panels.

4. A method of fire proofing a roof structure of a building of the type including a plurality of spaced apart rafters having a plurality of purlins mounted thereon, comprising:

attaching a plurality of support beams to the downwardly facing surface of the purlins;

attaching a plurality of fire resistant panels to the support beams;

urging the side edges of each successive panel into sealed contact with the side edges of adjacent panels; and after the adjacent side edges of successive panels have been urged into sealed contact with one another, securing the side edges of the panels to a support beam with a fastening member.

5. The method of claim 4 and wherein the step of attaching the fire resistant panels to the support beams comprises engaging the field of each panel with a fastening member and securing the field of each panel to the support beams.

6. The method of claim 5 and wherein the step of urging the adjacent side edges of each successive panel into sealed contact with the side edges of adjacent panels comprises creating a mitered joint between the adjacent panels to form a fire penetration seal between the panels.

7. The method of claim 4 and wherein the step of urging the side edges of each successive panel into sealed engagement with the side edges of adjacent panels comprises creating a lap joint between the adjacent panels to form a fire penetration seal between the panels.

8. The method of claim 4 and wherein the step of urging the side edges of each successive panel into sealed engagement with the side edges of adjacent panels comprises creating a tongue and groove joint between the adjacent panels to form a fire penetration seal between the panels.

9. An insulated fire resistant roof structure for a pre-engineered building or the like comprising:

a plurality of spaced apart approximately parallel rafter beams;

a plurality of approximately equally spaced purlins having upper and lower surfaces with their lower surfaces mounted on said rafters, said purlins being oriented approximately parallel to one another and at right angles to said rafters;

sheet metal roofing panels mounted on said purlins;

insulating blankets extending between said purlins to resist the transfer of heat through the roof structures;

a ceiling structure mounted to the lower surfaces of said purlins for forming an inside ceiling structure including a plurality of fire resistant panels arranged in edge-to-edge contact with one another with the edges of the panels in sealed engagement wedges of their adjacent panels, and means for securing the contacting edges of said panels to said ceiling structure.

10. The insulated roof structure of claim 9 and wherein said ceiling structure includes a plurality of support beams mounted to the lower surfaces of said purlins and said plurality of panels being fastened to said support beams.

11. The insulated roof structure of claim 9 and wherein said panels comprise compressible fire resistant material characterized by having been mounted in the ceiling structure with their side edges overlapping and the overlapped side edges of said fire resistant panels having been compressed and aligned with the edges of the adjacent panels so as to form compression seams between adjacent fire resistant panels, thus creating a substantially fire and vapor impermeable seal between each of said fire resistant panels.

12. The insulated roof structure of claim 9 and wherein said panels comprise compressible fire resistant material characterized by having been mounted in the ceiling structure with their side edges engaging one another so as to form a lap joint between adjacent fire resistant panels, thus creating a substantially fire and vapor impermeable seal between each of said fire resistant panels.

13. The insulated roof structure of claim 9 and wherein said panels comprise compressible fire resistant material characterized by having been mounted in the ceiling structure with their side edges in engagement with one another so as to form a mitered joint between adjacent fire resistant panels, thus creating a substantially fire and vapor impermeable seal between each of said fire resistant panels.

14. The insulated roof structure of claim 9 and wherein said panels comprise compressible fire resistant material characterized by having been mounted with their side edges in engagement with one another so as to form a tongue and groove joint between adjacent fire resistant panels, thus creating a substantially fire and vapor impermeable seal between each of said fire resistant panels.

15. A fire resistant roof structure of a building, comprising:

a plurality of approximately equally spaced parallel purlins having an upper surface and a lower surface;

a plurality of hard roofing panels secured to the upper surfaces of said purlins to form an outer roof surface;

a plurality of support beams attached to the lower surfaces of said purlins;

a plurality of fire resistant panels mounted to said support beams and positioned adjacent one another with the side edges of adjacent fire resistant panels abutting one another; and said panels comprising a compressible composite of fibrous heat insulating material characterized by having been mounted to said support beams with their edges overlapping the edges of adjacent panels and their edges compressed to fit in edge-to-edge abutment with their adjacent panels and forming sealed seams between adjacent panels.

16. The roof structure of claim 11 and wherein said support beams are approximately U-shaped in cross section having upwardly extending side walls and whereby said support beams are attached to the lower surfaces of said purlins by fastening means extending through said upwardly extending side walls and into contact with the lower surfaces of said purlins.

17. The roof structure of claim 16 and wherein said fastening means comprises a plurality of self-drilling screws.

18. The roof structure of claim 16 and wherein said fastening means comprises a plurality of mounting clips each having a substantially U-shaped upper portions and a pair of L-shaped arms depending from said upper portion and terminating in wedge-shaped end portions, whereby said upper portions of each of said mounting clips are hooked into engagement with the lower surface of said purlins with said L-shaped arms extending downwardly and said support beams are wedged upwardly such that said side walls of said support beams are engaged and held in place against the lower surface of said purlins by said wedge-shaped ends of each of said L-shaped arms of said mounting clips.

19. A fire resistant roof structure of a metal building or the like comprising:

a plurality of approximately parallel purlins, an upper layer of heat insulation extending over said purlins, hard roofing material extending over said upper layer of heat insulation and supported by said purlins, a plurality of support beams extending beneath and supported by said purlins and forming a lattice of support beams, fire resistant heat insulation panels extending beneath and mounted to said support beams in abutting edge-to-edge relationship with respect to one another to form a substantially continuous sealed fire resistant surface, and fasteners attaching said panels to said support beams including fasteners for securing the abutting edges of said panels to said support beams.

20. The fire resistant roof structure of claim 19 and wherein said fasteners are self tapping screws.

21. The fire resistant roof structure of claim 19 and wherein said fasteners extend from beneath said fire resistant panels upwardly through said panels and are attached to said support beams, whereby of the elements of the roof structure only the fasteners are exposed below the fire resistant heat insulation panels.

22. The fire resistant roof structure of claim 19 and wherein said upper layer of heat insulation comprises fiberglass blankets arranged edge-to-edge to form a continuous layer of blanket insulation material, and vapor barrier sheet underlying the blanket insulation.

23. The fire resistant roof structure of claim 19 and further including poultry netting extending beneath said fire resistant heat insulation panels.

24. The fire resistant roof structure of claim 23 and further including connector means connecting the poultry netting of adjacent panels.

25. A fire resistant roof structure of a metal building or the like comprising a plurality of purlins arranged parallel to one another, an upper layer of heat insulation material extending over said purlins, hard roofing panels extending over said heat insulation material and connected to said purlins, and a lower layer of heat insulation material extending beneath and supported from said purlins, said lower layer of heat insulation formed of a material to withstand heat in a temperature range including 1700° F. and said upper layer of heat insulation material formed of a material to withstand heat up to a temperature lower than the temperature that the lower level of insulation can withstand.

26. The fire resistant roof structure of claim 25 and wherein said lower level of heat insulation material comprises a plurality of panels arranged in edge-to-edge sealed abutment with one another.

* * * * *